US007686420B2

(12) United States Patent
Inoue et al.

(10) Patent No.: US 7,686,420 B2
(45) Date of Patent: Mar. 30, 2010

(54) INK JET RECORDING APPARATUS

(75) Inventors: Aya Inoue, Tokyo (JP); Takashi Nojima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 443 days.

(21) Appl. No.: 11/416,126

(22) Filed: May 3, 2006

(65) Prior Publication Data

US 2006/0256155 A1 Nov. 16, 2006

(30) Foreign Application Priority Data

May 12, 2005 (JP) ..... 2005-139426

(51) Int. Cl.
*B41J 2/165* (2006.01)

(52) U.S. Cl. ..... 347/33; 347/32; 347/29

(58) Field of Classification Search ..... 347/29, 347/30, 32, 33, 22
See application file for complete search history.

(56) References Cited

U.S. PATENT DOCUMENTS 5,917,517 A 6/1999 Kida et al.
6,109,725 A 8/2000 Saikawa et al.
6,497,473 B2 * 12/2002 Kim ..... 347/33
6,913,340 B2 * 7/2005 Tanaka et al. ..... 347/29
7,316,466 B2 * 1/2008 Uwagaki et al. ..... 347/33
2005/0259126 A1 11/2005 Tanaka et al.
2005/0275680 A1 12/2005 Inoue

FOREIGN PATENT DOCUMENTS

JP 2004-90550 3/2004

* cited by examiner

*Primary Examiner*—Shih-Wen Hsieh
(74) *Attorney, Agent, or Firm*—Fitzpatrick, Cella, Harper & Scinto

(57) ABSTRACT

A rotatable locking lever is provided in a slider and is movable in a direction intersecting a moving direction of a carriage, and the slider is made to stop in a wiping position by the locking lever being locked by an apparatus main body side when the slider moves to a wiping position. It is possible to regulate an approach amount of a wiper to a recording head with a high degree of accuracy even if horizontal portions are not provided on cam surfaces for restricting a position of the slider mounting the wiper.

5 Claims, 12 Drawing Sheets

INK JET RECORDING APPARATUS

BACKGROUND OF THE INVENTION

1. Field of the Invention

The present invention relates to an ink jet recording apparatus which performs recording by discharging ink on a recording medium from a recording head.

2. Related Background Art

In an ink jet recording apparatus which performs recording by discharging ink from a recording head on a recording medium such as a recording sheet, recording is performed by discharging the ink from a minute discharge port. Hence, a discharge failure resulting from thickening and fixing of ink due to evaporation of ink near a discharge port, adhesion of ink and foreign particles, such as paper powder, to a discharge port surface, and the like may arise. Hence, in an ink jet recording apparatus, by providing a recovery mechanism portion and performing a recovery action at predetermined intervals, ink discharging performance is maintained and recovered.

The recovery mechanism portion is for maintaining and recovering recording quality in a normal state by resolving a clogging and the like of a recording head which discharges ink and performs recording. This recovery mechanism portion comprises pumping means for sucking ink from a discharge port, capping means of making a cap abut and cover the discharge port, and wiping means of making a wiper rub a discharge port surface and wipe it. As conventional structure of this recovery mechanism portion, what is proposed is a structure that a slider which is movable only in a predetermined range and interlocking with a motion of a carriage mounting a recording head is provided, and a cap and a wiper are mounted in this slider.

FIG. 10 is a perspective view showing a recovery mechanism portion which is constructed of a slider in a conventional ink jet recording apparatus. In FIG. 10, wipers 8 and 9 are mounted with the caps 1A and 1B on a slider 7, and the slider 7 is movable along slider cams 13*a* and 13*b* provided in a base portion 13 of an apparatus main body. Hence, the wipers 8 and 9 and caps 1A and 1B are also regulated for positions in a vertical direction by moving with the slider 7 along cam surfaces of the slider cams 13*a* and 13*b*, and are controlled so as to take a predetermined capping position, a predetermined wiping position, and the like. In addition, a lock lever 4 which fixes the slider by locking the slider with the base portion 13 at the time of wiping operation is provided in the slider 7.

FIG. 11 is a partial cutaway front view showing a state at the time when the slider 7 in FIG. 10 advances to the capping position of the recovery mechanism portion with following the motion of the carriage. FIG. 12 is a partial cutaway front view showing a state at the time when the carriage inversely moves toward a recording region to thereby hold the slider 7 in the wiping position. In FIG. 11, when a recording mechanism portion which is constructed of a recording head 5 and a carriage 6 advances to the recovery mechanism portion, a right-hand side face of the carriage 6 abuts on a bumping portion 7*a* of the slider 7. Protrusions (or shanks) 7*b* are provided in a total of four places of both side faces of the slider 7, and these protrusions are made to abut on cam faces of the slider cams 13*a* and 13*b* provided in the base portion 13 in an apparatus main body side.

When the carriage 6 abuts on the bumping portion 7*a* and advances further, the slider 7 moves along the slider cams 13*a* and 13*b* with interlocking with (following) the motion of the carriage, and rises gradually. Then, when the carriage 6 moves to the capping position in FIG. 11, the caps 1A and 1B are stuck to discharge port surfaces 51 of recording heads 5A and 5B, and generate a capping state of sealing the discharge ports. When the carriage further moves in an approach direction from the capping position, a hook portion 4*b* provided in an end portion of the lock lever 4 clears a lock lever cam 13*c* in the side toward an apparatus main body 13 to move to the right-hand side in the figure, and is locked by the lock lever cam.

The lock lever 4 is energized leftward in the figure by a tension spring (return spring) 4*d* attached to the base portion 13. A slider insertion portion 4*c* is provided in the lock lever 4, and one end portion, which is in the left-hand side in the figure, among four protrusions 7*b* of the slider 7 is inserted into the slider insertion portion. The slider 7 inversely moves toward the recording region and then the protrusion 7*b* abuts on a left-hand edge face of the slider insertion portion 4*c*. Hence, the slider 7 is held (locked or stopped) in the wiping position in FIG. 12.

When the recording mechanism portion further moves toward the recording region, the recording mechanism portion is separated from the stopped slider. The wipers 8 and 9, which are constructed of blade-like rubbery elastic bodies, are installed in an end portion of the slider in the edge part toward the recording region. In addition, in the above-mentioned wiping position, the slider 7 is stopped in a height position where respective wipers 8 and 9 advance (overlap) to the discharge port surfaces 51 of the recording heads 5A and 5B only by a preferable amount. Then, when the carriage 6 further moves toward the recording region, a discharge port surface of each recording head rubs with each wiper, and a wiping operation which wipes the discharge port surface is performed.

When wiping is finished and the recording mechanism portion further moves toward the recording region, a lock lever release portion (not shown) of the carriage 6 abuts on a carriage abutting portion 4*a* of the lock lever 4, and presses this. This lock lever release portion is constructed of a protrusion or a step portion and the like, which are formed in a right-hand end portion of the carriage 6 in the figure. And, its height position is selected in a position where (1) the lock lever release portion does not contact the carriage abutting portion 4*a* when the carriage advances, that is, when the slider 7 and the lock lever 4 become in lowest positions, and (2) it contacts the carriage abutting portion when the lock lever release portion is in the wiping position where the slider 7 and the lock lever 4 rise to some extent.

In this way, when the lock lever release portion (not shown) abuts on the carriage abutting portion 4*a*, the lock lever 4 rotates counterclockwise in the figure and centers the protrusion 7*b* inserted in the slider insertion portion 4*c*. Thereby, since the hook portion 4*b* leaves the lock lever cam 13*c*, locking of the slider is released. The unlocked slider is returned to the original wiper evacuating position (downward position) by a slider spring 15 attached to the base portion 13. According to the above structure, it is possible to perform the capping operation and wiping operation by making the slider perform the following motion along the cam faces using the motion of the carriage.

Nevertheless, in the above-mentioned ink jet recording apparatus, although the wiping position of the slider 7 is regulated by the lock lever 4, there were the following technical tasks in this conventional locking means by the lock lever. That is, the above-mentioned conventional locking means is constructed so as to make the lock lever cam 13*c*, formed in the inner portion of the recovery mechanism portion of the apparatus main body, lock the lock lever connected to the slider to perform positional regulation of the slider only in a carriage moving direction. For this reason, it is necessary for the slider cams 13*a* and 13*b* to provide horizontal portions 13*f* having length corresponding to carriage motion at the time of the wiping operation.

In addition, since the lock lever 4 is connected to only one of four protrusions (shanks) 7*b* of the slider, a posture of the slider is apt to become unstable. Then, in order to stabilize the posture of the slider, it is necessary to make the lock lever cam 13*c* lock the lock lever in the state where the four protrusions are located in the horizontal portions 13*f*. In this way, since the horizontal portions 13*f* were required for the slider cams 13*a* and 13*b*, total length of the slider cams became long and size of the apparatus main body in a width direction was large.

In addition, for proper wiping operation, it is required for an approach amount (overlap amount) of the wipers 8 and 9 to the discharge port surfaces of the recording head 5 to be suitable. However, in the above-mentioned conventional structure, there are many factors for determining the height position of the wipers, which include height of the lock lever cam 13*c* of the apparatus main body, height of the horizontal portions 13*f* of the slider cams 13*a* and 13*b*, geometry of the lock lever 4, positions of the four protrusions 7*b* of the slider, and the like. Therefore, since the approach amount of the wipers was influenced by manufacturing errors of these portions to be changed quite greatly, it was difficult to maintain the approach amount in a suitable amount. Thus, in order to stably secure the suitable approach amount, it has been demanded to greatly enhance manufacturing accuracy of each portion.

SUMMARY OF THE INVENTION

The present invention aims at providing an ink jet recording apparatus which can regulate an approach amount of a wiper to a recording head with high degree of accuracy even if horizontal portions are not provided on cam surfaces for restricting a position of a slider mounting the wiper.

In addition, the present invention also aims at providing an ink jet recording apparatus which comprises a carriage for performing reciprocation with mounting a recording head which discharges ink to perform recording on a recording medium, a slider which mounts a wiper for wiping a recording head, and is movable with following the motion of the carriage, and locking means which is arranged in the slider and is used for locking the slider in a wiping position where the wiper wipes the recording head, wherein the locking means regulates a position of the slider by locking the slider with an apparatus main body side when the slider has moved to the wiping position.

DETAILED DESCRIPTION OF THE PREFERRED EMBODIMENTS

Figure 1:
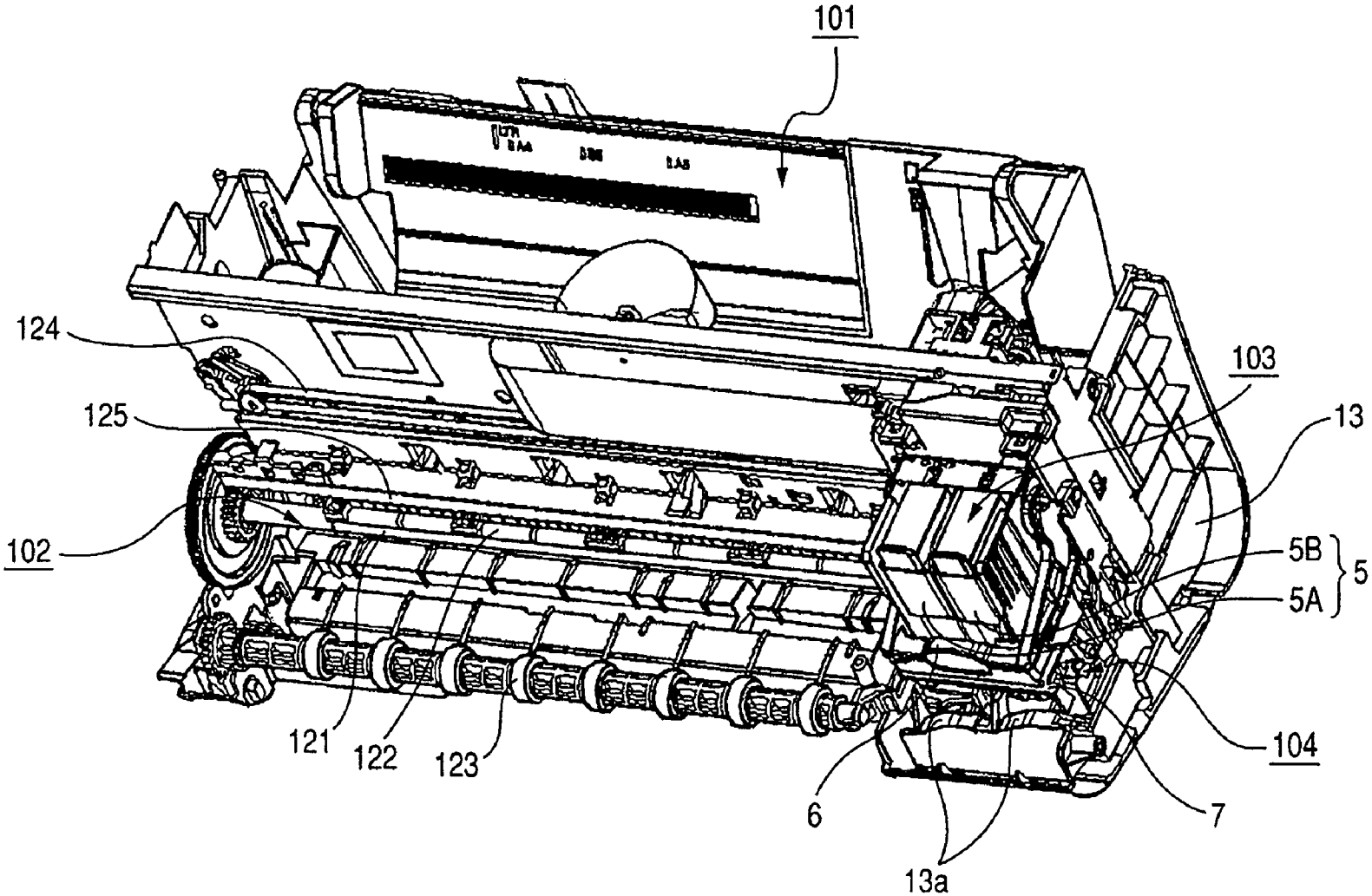
FIG. 1 is a perspective view showing one embodiment of an ink jet recording apparatus to which the present invention is applied.

Hereafter, embodiments of the present invention will be explained specifically with reference to drawings. In addition, over respective drawings, the same reference numerals denote the same or corresponding parts. In addition, when all or any of a plurality of similar parts or positions are pointed in the case that the same number with a symbol is assigned to them, only the number is shown without the symbol. FIG. 1 is a perspective view showing one embodiment of an ink jet recording apparatus to which the present invention is applied. In FIG. 1, the ink jet recording apparatus shown comprises a sheet feeding portion 101, a conveying portion 102, a recording mechanism portion (scan unit) 103, and a recovery mechanism portion (cleaning mechanism portion) 104. The sheet feeding portion feeds a recording media, such as a recording sheet, into an apparatus main body. The conveying portion conveys a recording medium through the inside of then apparatus main body. The recording mechanism portion records an image on a recording medium on the basis of image information. A recovery mechanism portion maintains and recovers ink ejection performance of a recording head so as to hold quality of an image recorded.

A recording medium loaded into the sheet feeding portion 101 is separated one by one by a sheet feeding roller driven by a sheet feeding motor to be fed to the conveying portion 102. The recording medium fed by the conveying portion 102 is conveyed through a recording portion by a conveying roller 121 and a pinch roller 122 which are driven by a conveying motor. The recording portion performs recording on a recording medium by the recording mechanism part 103. A recording head 5 mounted in a carriage 6 which moves in a main scanning direction is driven on the basis of image information, and recording is performed by discharging ink from a discharge port of the recording head. The recording medium recorded is discharged out of the apparatus main body by a sheet discharging roller 123, which is synchronously driven with the conveying roller 121, and a spur pressed thereby.

The recording mechanism portion 103 comprises the carriage 6 which is guided and supported reciprocatably in a main scanning direction, and recording cartridges 3A and 3B mounted in the carriage. The carriage 6 is guided and supported reciprocatably along a guide shaft and a guide rail which are installed in the apparatus main body, and is reciprocatingly driven through a carriage belt 124 by a carriage motor. The motion of the recording mechanism portion 103 is controlled by a position and speed being detected by an encoder sensor, mounted in the carriage 6, and an encoder scale 125 positioned on the apparatus main body. Recording of the whole recording medium is performed by repeating recording operation of the recording head 5, which is performed synchronously with the motion (main scanning) of the carriage 6 and conveyance (subscanning) of the recording medium every predetermined pitch.

Figure 4:
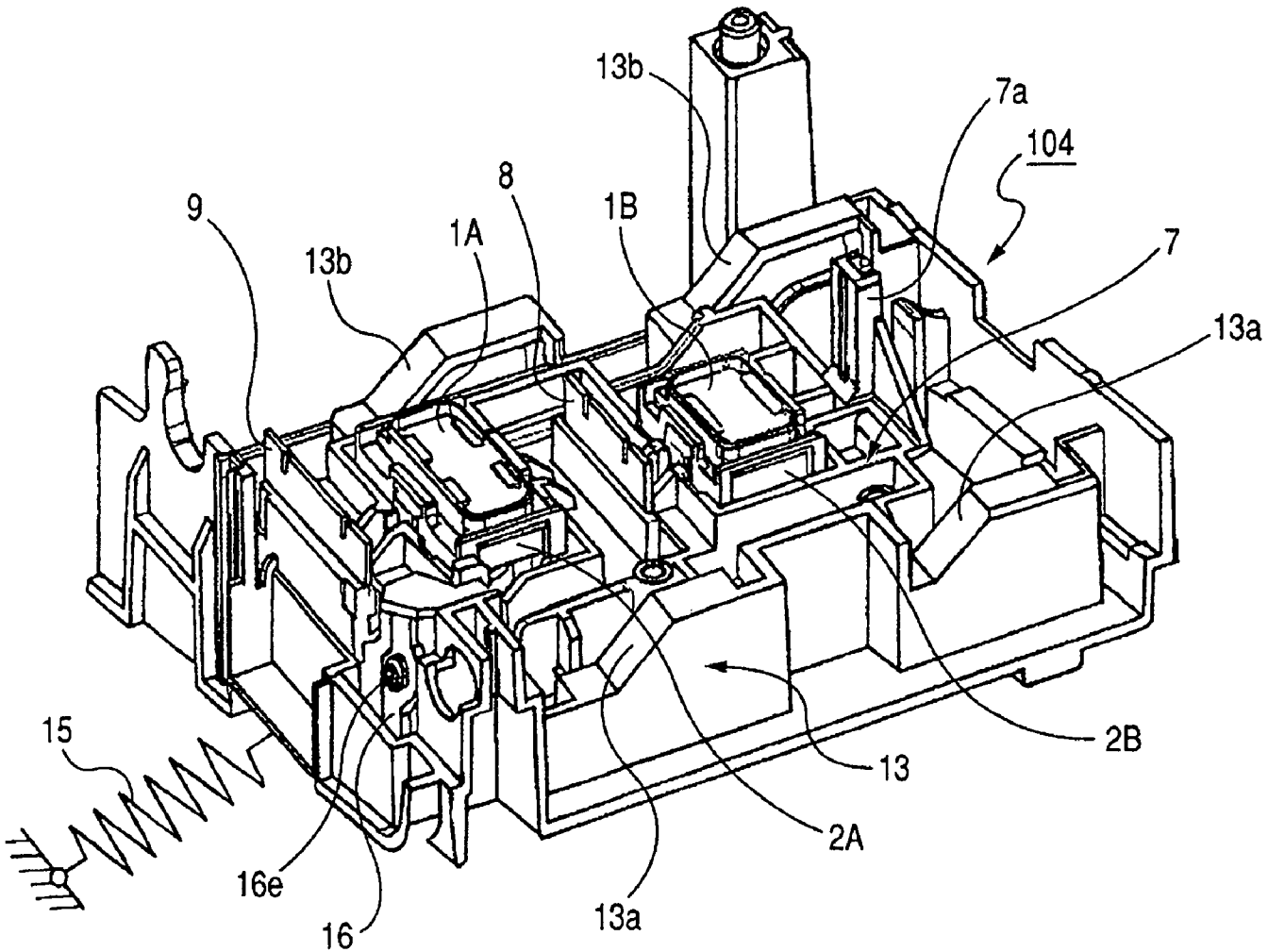
FIG. 4 is a perspective view showing a recovery mechanism portion in the one embodiment of the ink jet recording apparatus to which the present invention is applied.

The recovery mechanism portion 104 is for maintaining and recovering quality of a recorded image in a normal state by resolving a clogging and the like of a discharge port of the recording head 5. This recovery mechanism portion comprises capping means for covering the discharge port, suction means, such as a pump, for sucking ink from the discharge port, and wiping means for wiping a discharge port surface. The recovery mechanism portion 104 of this embodiment comprises the slider 7 which can move over a predetermined range with the carriage when the carriage 6 has moved to the recovery mechanism portion, as shown in FIG. 4. Then, caps 1A and 1B of the capping means and wipers 8 and 9 of the wiping means are mounted in a slider 7. The detail of this slider 7 will be described later.

Figure 2:
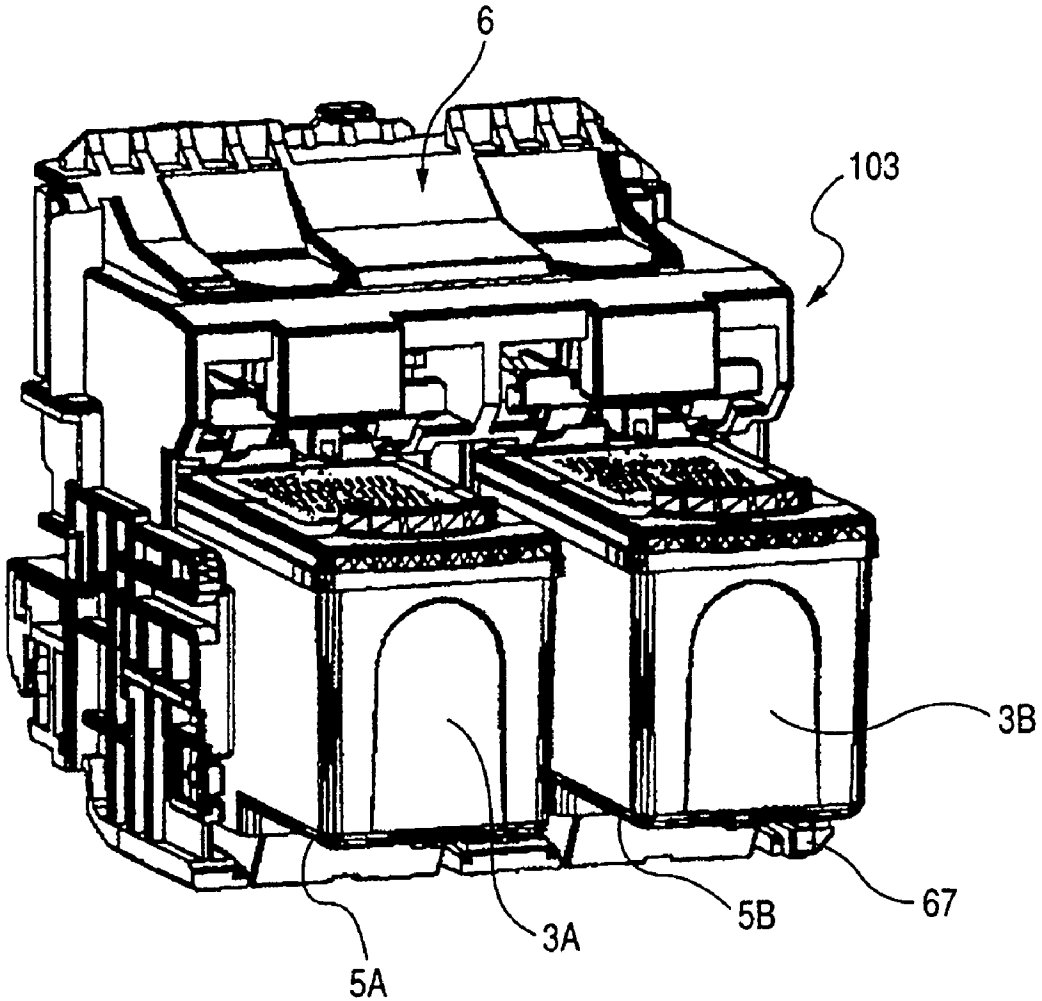
FIG. 2 is a perspective view of a recording mechanism portion of the ink jet recording apparatus in FIG. 1 from the viewpoint of the front.
Figure 3:
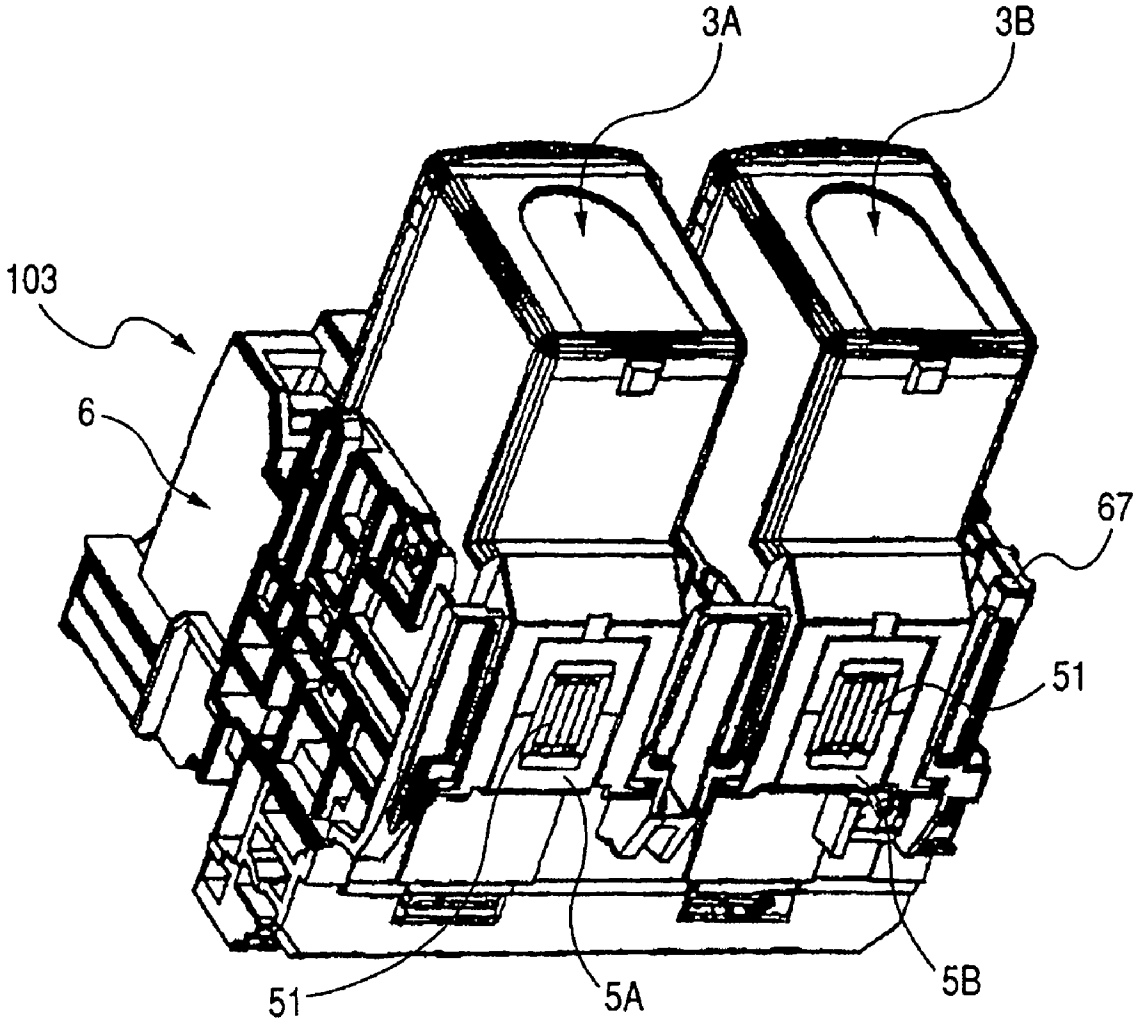
FIG. 3 is a perspective view of the recording mechanism portion in FIG. 2 from the viewpoint of a bottom.

FIG. 2 is a perspective view of the recording mechanism portion 103 in FIG. 1 from the viewpoint of the front. FIG. 3 is a perspective view of the recording mechanism portion in FIG. 2 from the viewpoint of a bottom. In FIGS. 2 and 3, a plurality (two pieces) of record cartridges 3A and 3B are mounted on the carriage 6, each of the record cartridges is constructed of an ink cartridge where a recording head and an ink tank are unified. The recording head 5A performing recording using a plurality of colors of ink is provided in the record cartridge 3A for color. On the other hand, the recording head 5B performing recording using a single color (e.g., black) of ink is provided in the record cartridge 3B for a single color. Discharge port arrays 52 of three colors, such as cyan, magenta, and yellow, are formed in the discharge port surfaces 51 of a recording head 5A. The discharge port array 52 of a single color, such as black, is formed in the discharge port surface 51 of a recording head 5B.

FIG. 4 is a perspective view showing the recovery mechanism portion in the one embodiment of the ink jet recording apparatus to which the present invention is applied. The recovery mechanism portion 104 is for maintaining and recovering quality of a recorded image in a normal state by resolving a clogging and the like of a discharge port of the recording head 5. In FIG. 4, the capping means having the caps 1A and 1B for covering the discharge ports of the recording heads 5A and 5B, and the wipers 8 and 9 for wiping the discharge port surface 51 of each recording head are mounted in the slider 7. The slider 7 is mounted so as to be able to move with following the recording mechanism portion 103 over a predetermined range when the recording mechanism portion 103 has advanced to the recovery mechanism portion 104. Hence, the slider 7 is controlled to take a predetermined height position in each position (the capping position, wiping position, wiper evacuating (or retracted) position, etc.) in a carriage moving direction by moving along cam faces of the slider cams 13*a* and 13*b* provided in the base portion 13 of the apparatus main body. In addition, since a cap 1 is connected to the suction means, such as a pump, it is also possible to perform suction recovery operation refreshing ink in the discharge port by sucking the ink from the discharge port of the recording head which is capped.

Figure 5:
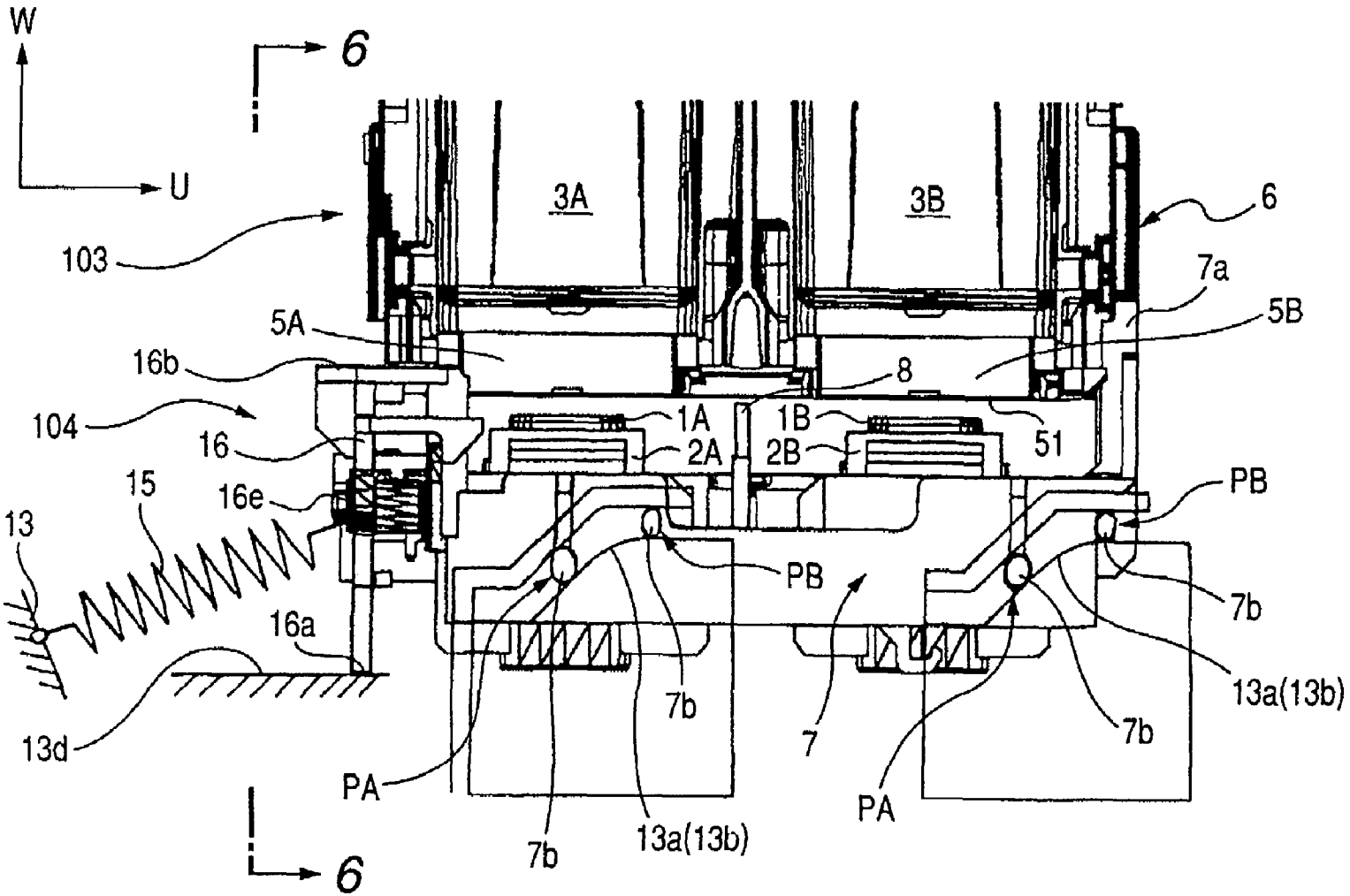
FIG. 5 is a front view showing a state that the recording mechanism portion advances to the recovery mechanism portion and a slider performs following motion in the ink jet recording apparatus to which the present invention is applied.
Figure 6:
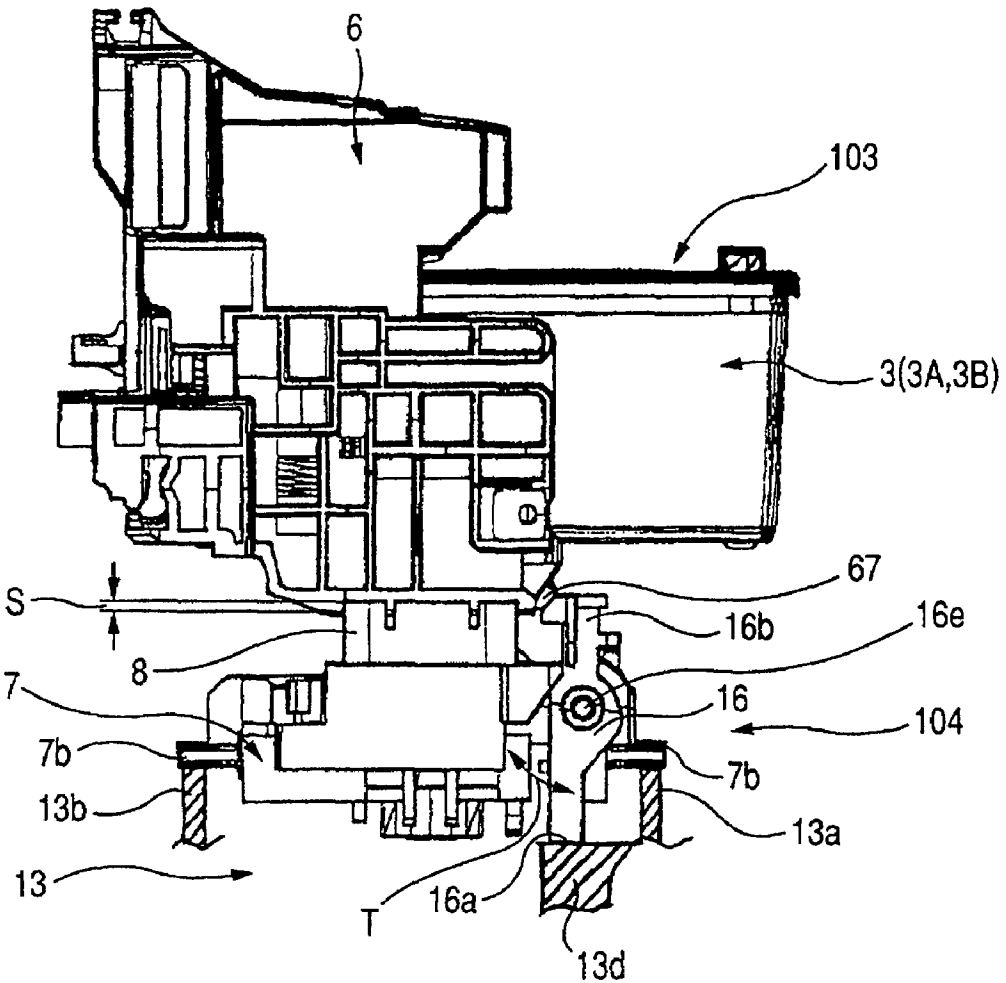
FIG. 6 is a side view from the viewpoint along line 6-6 in FIG. 5.
Figure 7:
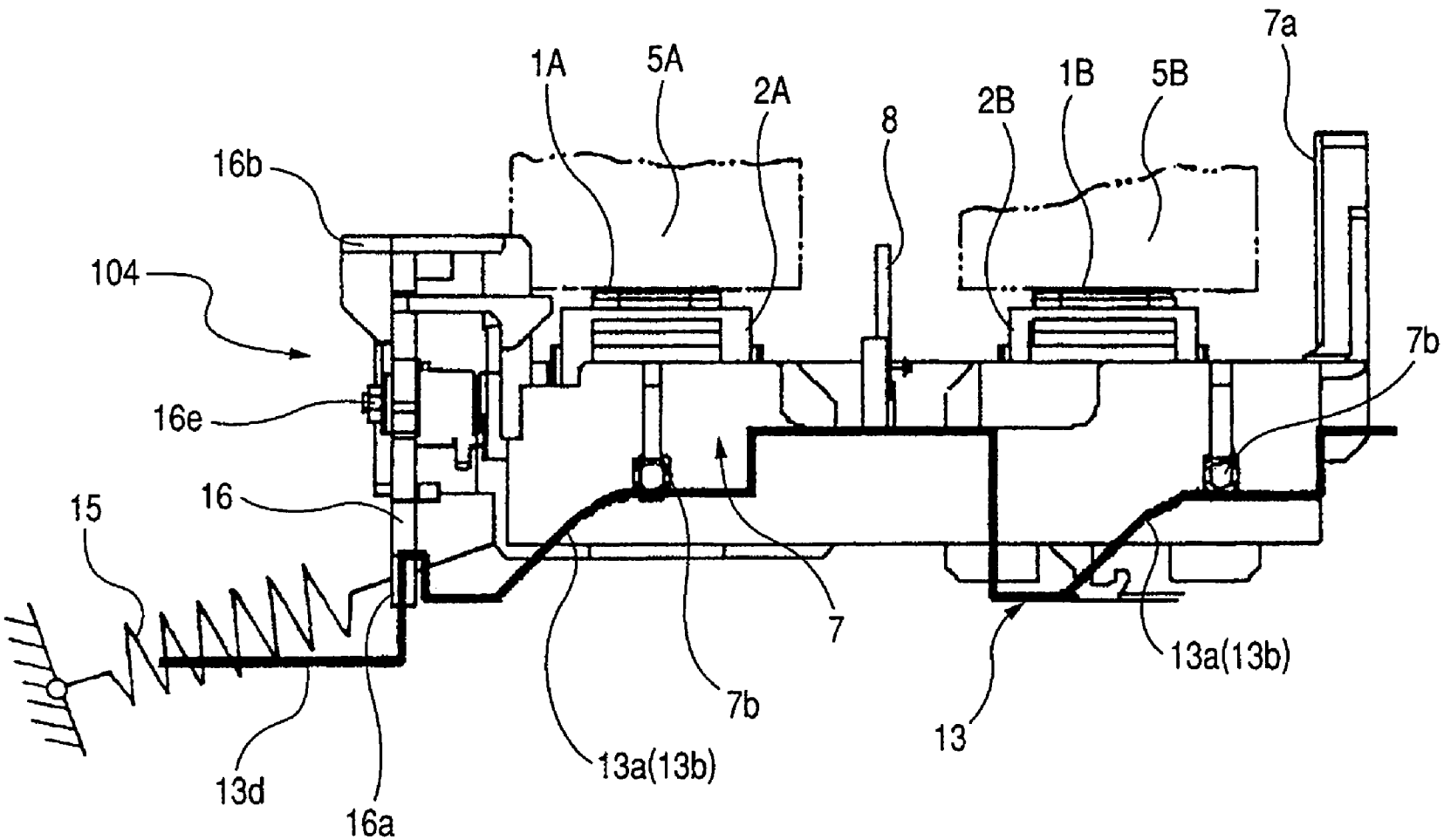
FIG. 7 is a front view showing a state that the slider is in a capping position in the recovery mechanism portion of the ink jet recording apparatus to which the present invention is applied.
Figure 8:
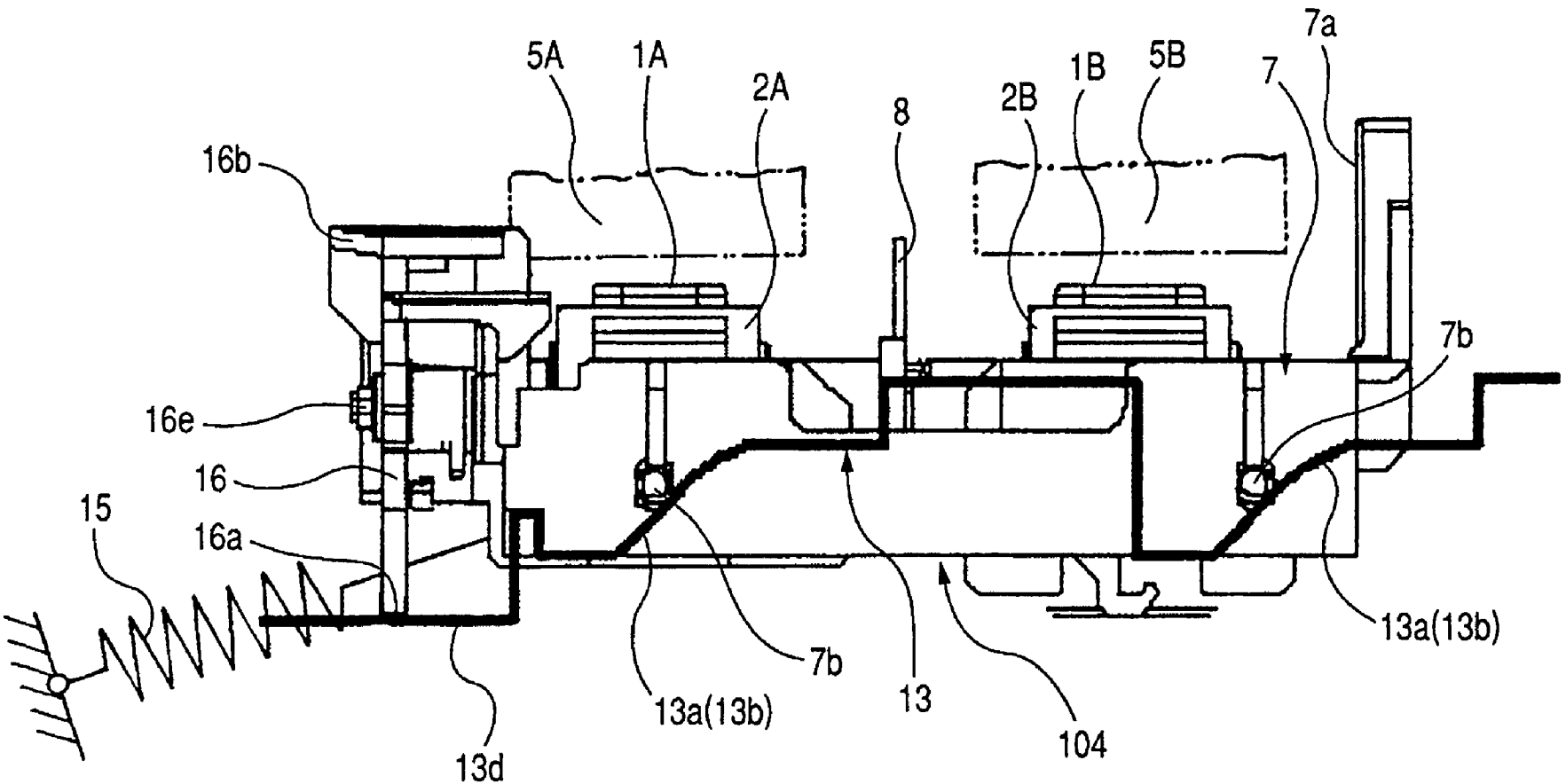
FIG. 8 is a front view showing a state that the slider is in a wiping position in the recovery mechanism portion in FIG. 7.
Figure 9:
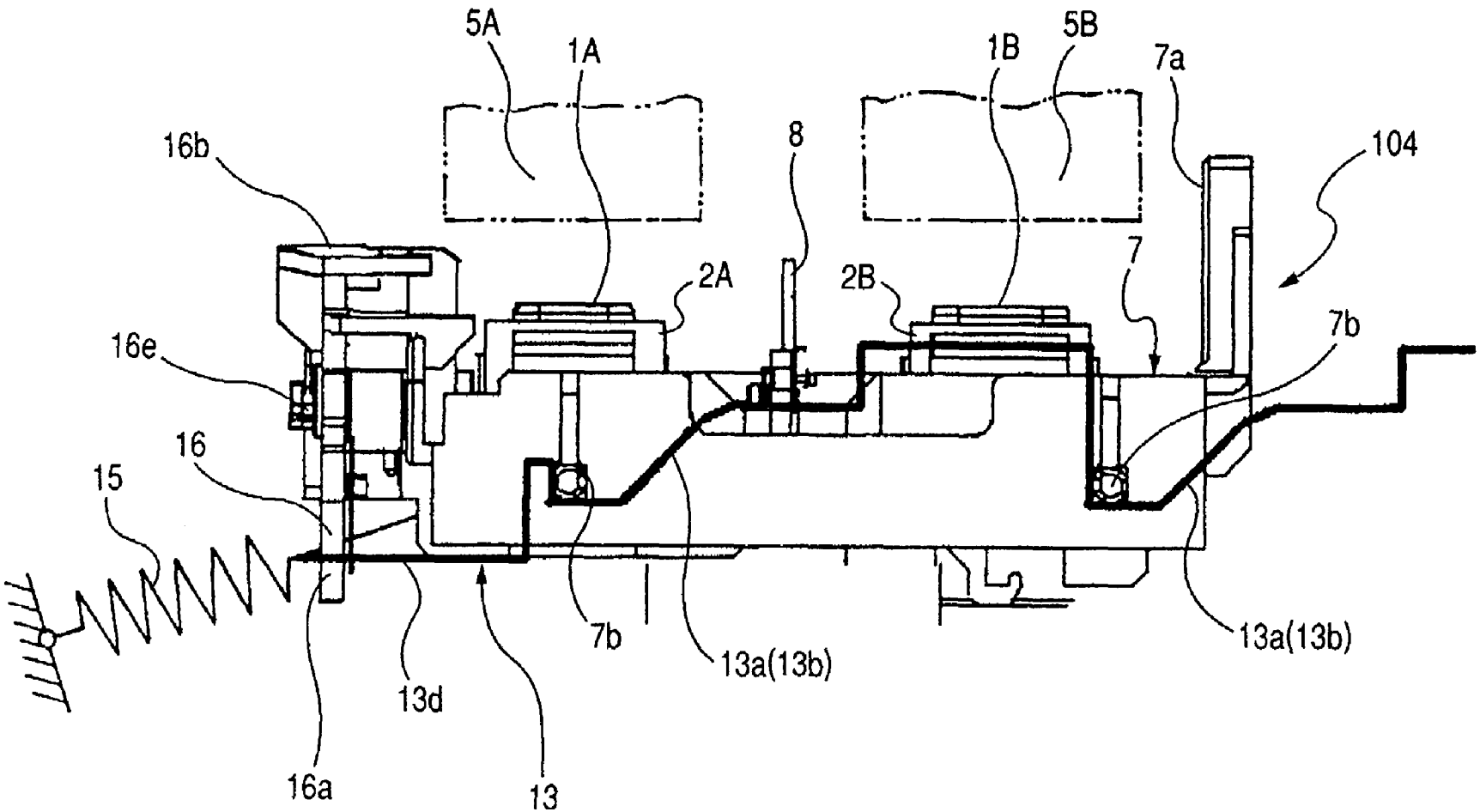
FIG. 9 is a front view showing the state that the slider is in a wiper evacuating (or retracted) position in the recovery mechanism portion in FIG. 7.
Figure 10:
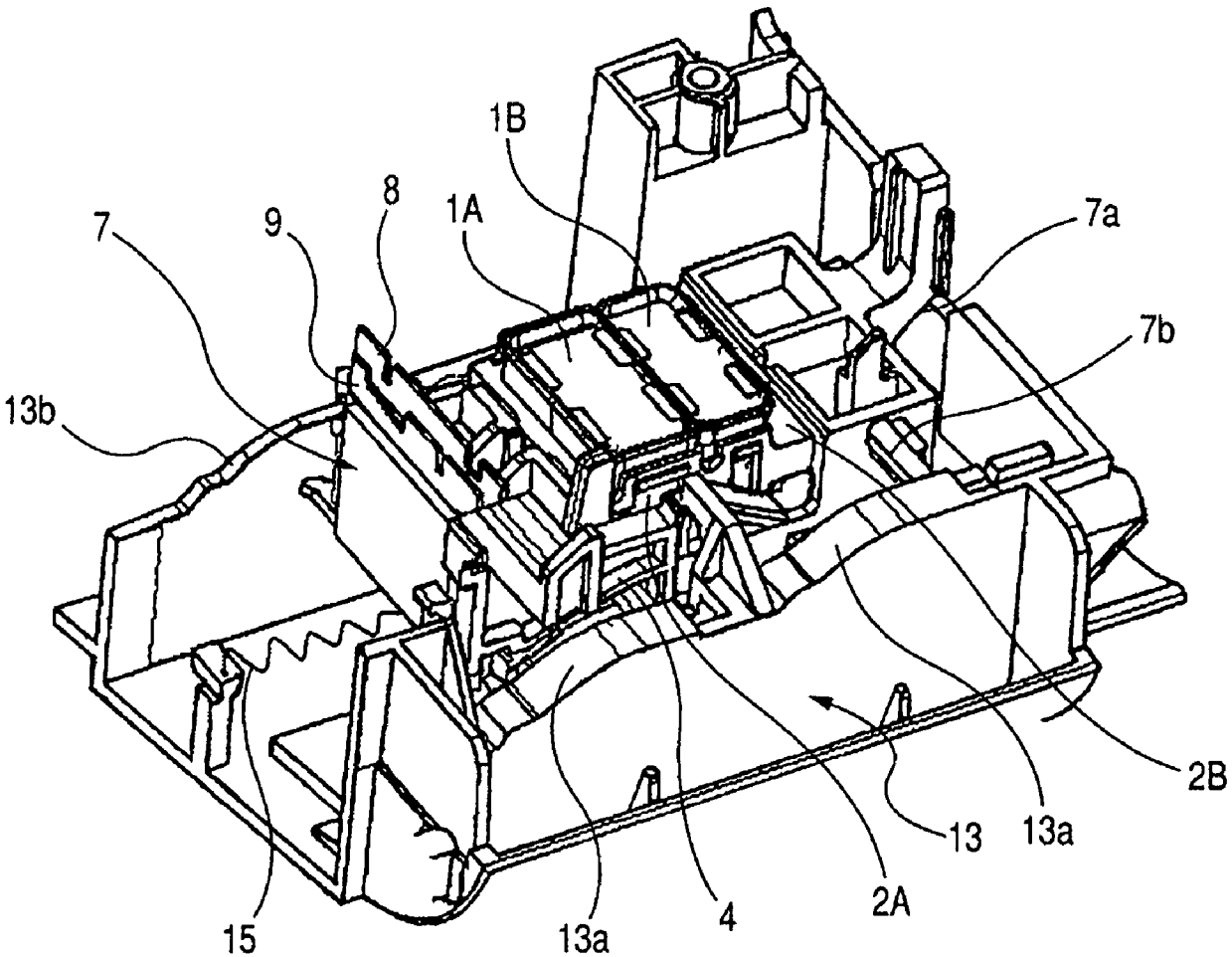
FIG. 10 is a perspective view showing a recovery mechanism portion, which is constructed of a slider, in a conventional ink jet recording apparatus.
Figure 11:
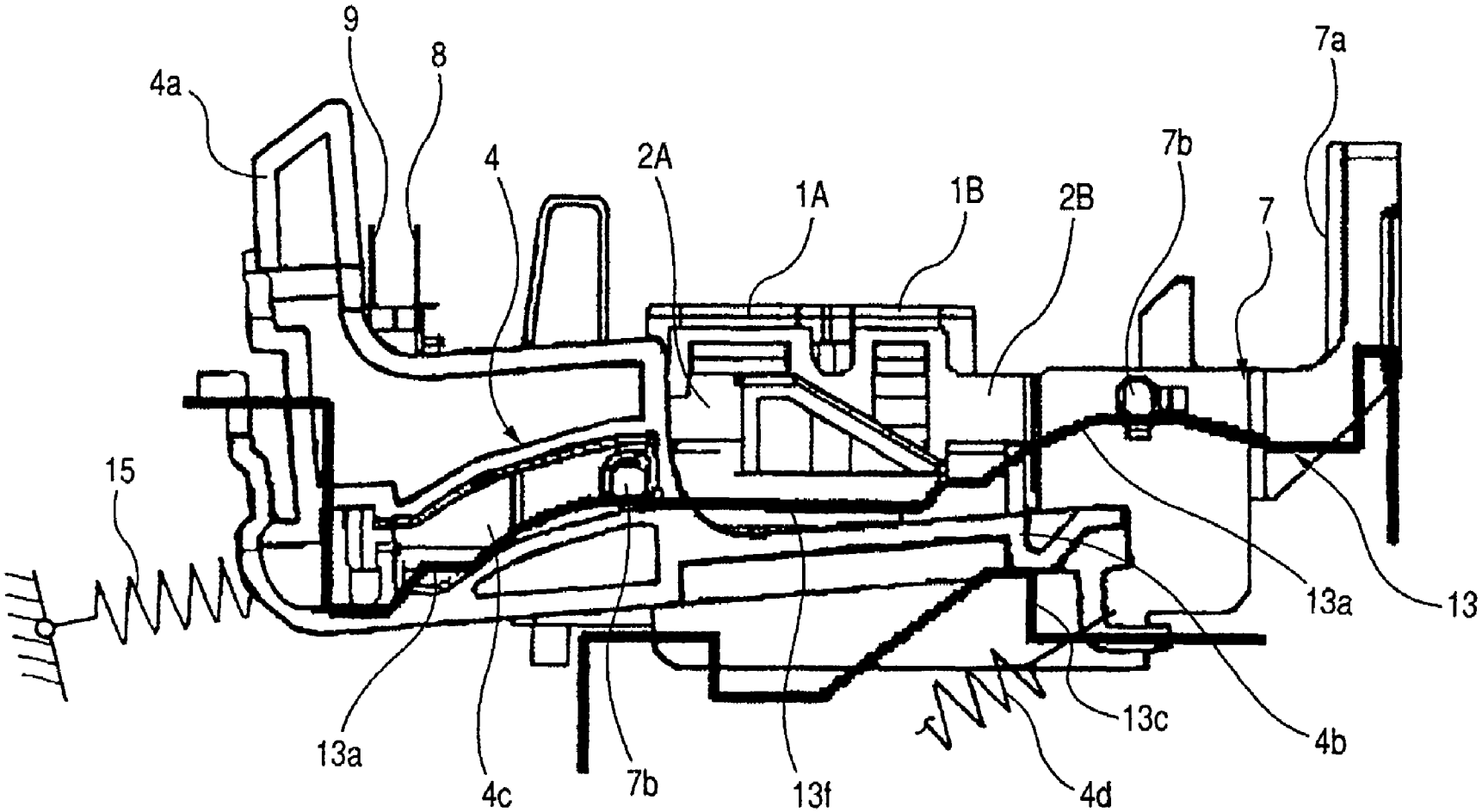
FIG. 11 is a front view showing a state at the time when the slider in FIG. 10 advances to a capping position of the recovery mechanism portion with following the motion of a carriage.
Figure 12:
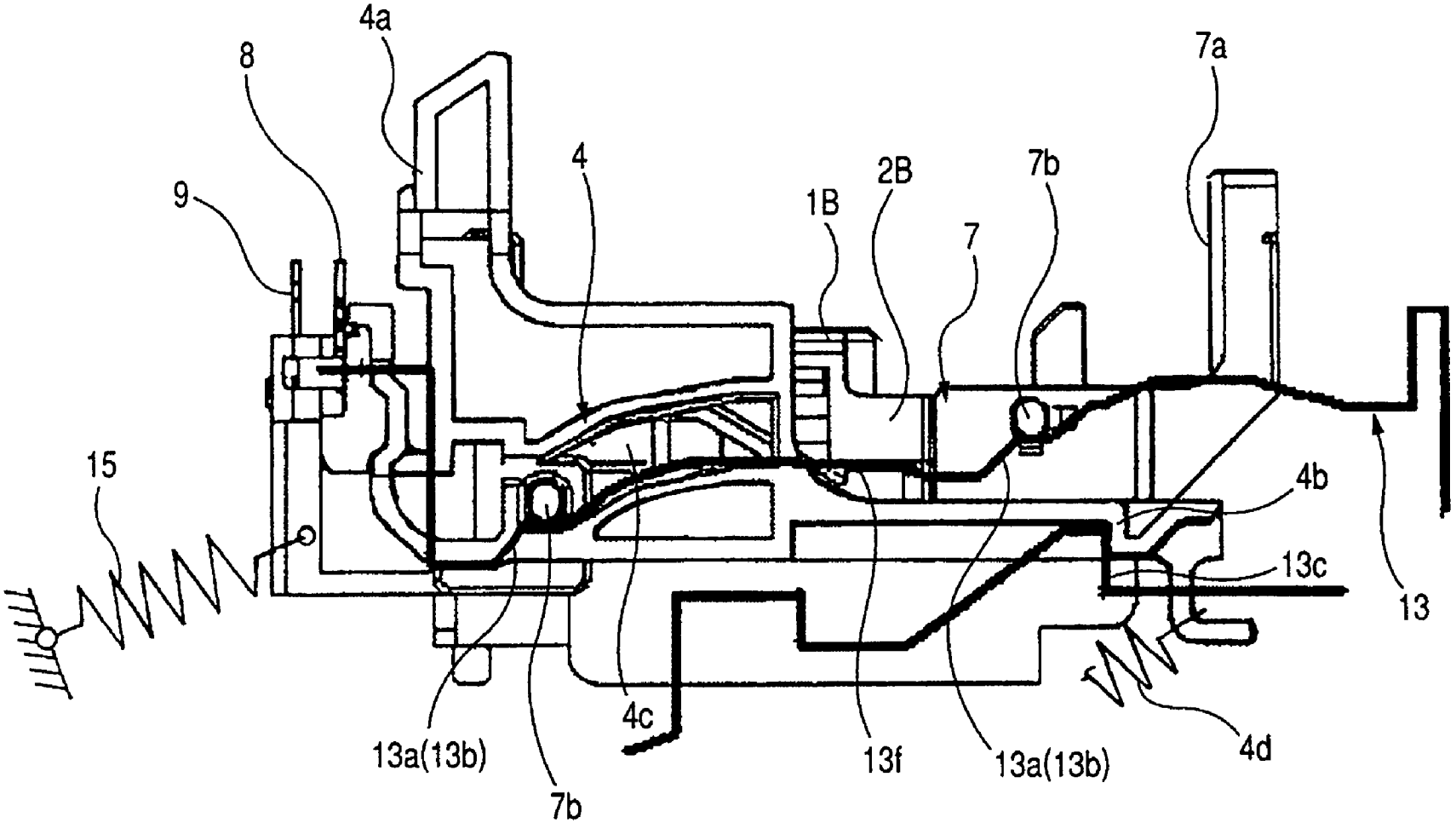
FIG. 12 is a front view showing a state at the time when the carriage inversely moves toward a recording region to thereby hold the slider in a wiping position.

FIG. 5 is a front view showing a state that the recording mechanism portion advances to the recovery mechanism portion, and the slider performs following motion. FIG. 6 is a side view from the viewpoint along line 6-6 in FIG. 5. FIG. 7 is a front view of the recovery mechanism portion at the time when the slider is in the capping position. FIG. 8 is a front view of the recovery mechanism portion at the time when the slider is in the wiping position. FIG. 9 is a front view of the recovery mechanism portion at the time when the slider is in the wiper evacuating position.

Next, the recovery mechanism portion 104 of this embodiment will be explained. In FIGS. 4 to 9, the caps 1A and 1B for performing capping of the respective discharge port surfaces 51 of two recording heads 5A and 5B are held at cap holders 2A and 2B. Each cap holder is installed in the slider 7 by two claw portions. A cap spring is mounted between each cap holder and the slider 7, and the cap and cap holder are energized upward by the cap spring. The caps 1A and 1B are arranged at predetermined intervals in a carriage moving direction, and one wiper 8 is arranged between both caps and another wiper 9 is arranged in a left-hand end portion (end portion toward the recording region) in the figure.

An inside of each of the caps 1A and 1B is connected to the suction pump, which is not shown and is negative pressure generation means, through a tube not shown. By generating negative pressure inside the cap by activating the suction pump in a state that the recording head is capped with the cap, it becomes possible to suck ink from the discharge port of the recording head by this negative pressure. It is possible to maintain and recover the ink ejection performance of the recording head by discharging a bubble, sticking ink, etc. in the ink in an ink flow path of the recording head in such sucking operation.

Four rod-like protrusions (or shanks) 7*b* protruding in a transverse direction are provided on both side faces of the slider 7. Four protrusions 7*b* abut on the cam faces of slider cams 13*a* and 13*b* provided in a base portion 13. In addition, the slider 7 is energized toward the recording region in a diagonally lower direction by a slider spring 15 attached to the base portion 13. Hence, the slider 7 is movably mounted in a state of making respective protrusions 7*b* abut on the cam faces of the slider cams 13*a* and 13*b* by the slider spring 15. A bumping part 7*a* on which a side face of the carriage 6 which has advanced can abut is provided in a right-hand end part of the slider 7 in the figure.

In FIGS. 4 to 9, locking means for making the slider locked (stopped) in a wiping position is provided in a side end portion of the recording region on the slider 7, and in a position in a downstream side of a conveying direction. As will be mentioned later, when the slider has moved to the wiping position (FIG. 8) in order to wipe the recording head, this locking means acts so that the slider may be given position regulation in the wiping position by locking the slider with the apparatus main body. This locking means is constructed of a lock lever 16 which is rotatable in a direction, shown by arrow T in FIG. 6, in an approximately perpendicular plane of a direction (conveying direction) which intersects a carriage moving direction. This lock lever 16 is rotatably supported by a support shaft 16*e* in its intermediate portion. In addition, this lock lever 16 is rotatably supported with a predetermined frictional force by being spring-energized in a radial direction or a thrust direction with the support shaft 16*e*. Hence, unless an external torque equal to or more than a predetermined value acts, the lock lever 16 is held in a rotary position displaced by an external force, etc.

A lock face 13*d* which can lock a lower end portion 16*a* when the lock lever 16 becomes approximately vertical is provided in the base portion 13 of the apparatus main body. In addition, an abutting portion (not shown) for rotating the lock lever counterclockwise in FIG. 6 by abutting on a top portion 16*b* of the lock lever 16 when the recording mechanism portion 103 approaches and moves to the recovery mechanism portion 104, and making the lower end portion 16*a* lock on the lock face 13*d*, is provided in a lower portion of the carriage 6. Furthermore, an unlocking protruding portion 67 for rotating the lock lever clockwise in FIG. 6 by abutting on the top portion 16*b* of the lock lever in the lock position (approximately vertical posture) when the recording mechanism portion 103 moves toward the recording region, and making the lower end portion 16*a* leave from the lock face 13*d*, is provided in a lower portion of the carriage 6.

Next, operation of the recovery mechanism portion 104 will be explained with reference to FIGS. 4 to 9. In FIGS. 4 to 9, when the recording mechanism portion 103 which mounts the recording head 5 in the carriage 6 moves to out of the recording region and advances to the recovery mechanism portion 104, a side face portion of the carriage 6 abuts on the bumping portion 7*a* of the slider 7. Then, the slider 7 follows the recording mechanism portion 103, and moves in an approach direction (rightwards in the figure). The slider 7 rises along the cam faces of the slider cams 13*a* and 13*b* with motion in the approach direction. When the slider 7 advances and reaches to a highest position (capping position) as shown in FIG. 7, the caps 1A and 1B on the slider are pressed onto the discharge port surfaces 51 of the recording heads 5A and 5B, and the capping state of covering the discharge port occurs.

In addition, in a state that the recording mechanism portion 103 does not move to a region of the recovery mechanism portion 104, such as during recording operation, etc., the lock lever 16 is in a release position (inclining posture) where the lock lever 16 rotates clockwise from the vertical position shown in FIG. 6. Thus, when the recording mechanism portion 103 advances into the recovery mechanism portion 104 as mentioned above, the abutting portion (not shown) provided in the lower portion of the carriage 6 abuts on the top portion 16*b* of the lock lever 16. By this abutting, the lock lever rotates counterclockwise in FIG. 6. Then, the lock lever 16 is held by a frictional holding force in a vertical posture in which the lower end portion 16*a* can be locked by the lock face 13*d*.

When the carriage 6 reverses a moving direction and starts to move toward the recording region from the capping position, simultaneously, the slider 7 moves along the slider cams 13*a* and 13*b* by operation of the slider spring 15, and starts to fall. Then, when the slider 7 moves to the wiping position where the slider 7 falls by a predetermined amount as shown in FIG. 8, the lower end portion 16*a* of the lock lever 16 held in the lock position by the frictional force on the slider 7 is made to abut on the lock face 13*d* of the base portion. Thereby, the slider 7 stops in the wiping position as shown in FIGS. 6 and 8, and is stopped (locked) in this position. Hence, when the recording mechanism portion 103 moves toward the recording region further from this wiping position (leftward in FIG. 8), the recording mechanism portion 103 separates from the slider 7.

When the recording mechanism portion 103 further moves toward the recording region, the wipers 8 and 9 mounted in the slider 7 rub against the discharge port surfaces 51 of the recording head 5 mounted in the carriage 6, and wiping operation is performed. At this time, as clear from FIG. 8, wipers 8 and 9 are mounted in the left-hand end portion and central portion of the slider 7 as illustrated. Hence, the left-hand recording head 5A is wiped with the left-hand wiper 9, and the right-hand recording head 5B is wiped with both of wipers 8 and 9.

Furthermore, after the carriage 6 moves toward the recording region and the two pieces of wipers 8 and 9 pass the discharge port surfaces of the recording head 5 completely, the unlocking protruding portion 67 provided in the right-hand lower portion of the carriage 6 presses the top portion (carriage abutting portion) 16*a* of the lock lever 16. By this pressing, the lock lever 16 is rotated clockwise in FIG. 6 with centering the support shaft 16*e*. Hence, the locking portion 16*a* of the lower end portion of the lock lever 16 separates from the lock face 13*d* of the base portion, and the fixation (lock) by the lock lever of the slider 7 is also released. The slider 7 which is unlocked moves by the slider spring 15 to the lowermost portion of the slider cams 13*a* and 13*b* toward the recording region, and is returned to the downward position where the slider 7 is completely evacuated from the wipers 8 and 9 as shown in FIG. 9.

According to the locking means using the above lock lever 16, it becomes possible to position and stop the slider 7, in which the wipers 8 and 9 are mounted, in an accurate and stable state. In addition, it is possible to omit horizontal portions 13*f* needed in cam faces of a conventional slider cam for a wiping position. For this reason, it is possible to determine a height position of the wipers 8 and 9 with a posture stabilized by forming the slider cams 13*a* and 13*b* only with a slope or a circular arc. Simultaneously, since it becomes possible to reduce the width of the apparatus main body by miniaturization of the recovery mechanism portion 104 by reduction of length of the slider cams, it becomes possible to miniaturize and lighten the apparatus.

Furthermore, it becomes possible to regulate an approach amount S (FIG. 6) of the wipers 8 and 9 to the recording head 5 in high precision by making only a part of the lock lever 16 determines the height position of the slider 7. Hence, it becomes possible to achieve a proper and effective wiping operation by the recovery mechanism portion 103. In addition, although the case that two recording heads are wiped with two wipers is mentioned as an example in the above embodiment, the present invention can be applied regardless of the number of recording heads or the number of wipers, and performs similar operations and effects.

According to the embodiment of the present invention with the above-mentioned structure, the slider is stopped in the wiping position by the locking means locking the slider with the apparatus main body. Hence, it is possible to hold the slider in a predetermined height position in a stable posture without providing horizontal portions in cam faces for performing positional regulation of the slider. Because of this structure, it is possible to provide an ink jet recording apparatus which can reduce the size of an apparatus main body in a width direction, and can regulate an approach amount of a wiper to a recording head in high precision.

This application claims priority from Japanese Patent Application No. 2005-139426 filed May 12, 2005, which is hereby incorporated by reference herein.

What is claimed is:

1. An ink jet recording apparatus, comprising:

a carriage for performing reciprocation in a moving direction with a mounted recording head, which discharges ink to perform recording on a recording medium in a recording region;

a slider which mounts a wiper for wiping the recording head, and is movable following the motion of the carriage; and a locking lever which is attached to a first side end portion of the slider which is closer to the recording region than a second side end portion in the moving direction and is used for locking the slider in a wiping position where the wiper wipes the recording head, wherein the locking lever regulates a position of the slider by locking the slider onto a base surface of an apparatus main body so as to fix the slider at a predetermined height relative to the base surface when the slider has moved to the wiping position with the locking lever being in a locking position, wherein the locking lever moves between the locking position which is capable of contacting with the base surface and a release position which is incapable of contacting with the base surface, and the locking lever moves to the locking position from the release position by being urged by the carriage as the carriage moves toward the slider from the recording region, and moves to the release position from the locking position by being urged by the carriage as the carriage moves toward the recording region from the wiping position, and wherein the locking lever is rotatable with a rotational shaft extending along the moving direction between the release position and the locking position.

2. The ink jet recording apparatus according to claim 1, wherein a cap for covering a discharge port of the recording head is mounted on the slider.

3. The ink jet recording apparatus according to claim 2, wherein a capping position where the cap covers the discharge port of the recording head, and an evacuating position where the wiper separates from the recording head are provided in a cam surface for regulating positions of the slider, and the wiping position is provided between the capping position and the evacuating position.

4. The ink jet recording apparatus according to claim 1, further comprising a spring connected to the slider such that the slider is energized toward the recording region in the moving direction.

5. The ink jet recording apparatus according to claim 4, wherein the slider is energized toward the recording region in a diagonally lower direction by the slider spring.

* * * * *